US008036390B2

(12) United States Patent
Goto et al.

(10) Patent No.: US 8,036,390 B2
(45) Date of Patent: Oct. 11, 2011

(54) SCALABLE ENCODING DEVICE AND SCALABLE ENCODING METHOD

(75) Inventors: Michiyo Goto, Tokyo (JP); Koji Yoshida, Kanagawa (JP)

(73) Assignee: Panasonic Corporation, Osaka (JP)

( * ) Notice: Subject to any disclaimer, the term of this patent is extended or adjusted under 35 U.S.C. 154(b) by 1106 days.

(21) Appl. No.: 11/815,028

(22) PCT Filed: Jan. 30, 2006

(86) PCT No.: PCT/JP2006/301481

§ 371 (c)(1),
(2), (4) Date: Jul. 30, 2007

(87) PCT Pub. No.: WO2006/082790

PCT Pub. Date: Aug. 10, 2006

(65) Prior Publication Data

US 2009/0041255 A1 Feb. 12, 2009

(30) Foreign Application Priority Data

Feb. 1, 2005 (JP) ..... 2005-025123

(51) Int. Cl.
*H04R 5/00* (2006.01)

(52) U.S. Cl. ..... 381/17; 381/23; 704/219; 704/220; 704/223; 704/258; 704/500; 704/501; 704/264

(58) Field of Classification Search ..... 381/17, 381/1, 22–23; 704/200, 200.1, 222–223, 704/258, 264, 500–501, 504, E13.007, E19.038, 704/E10.035, 220, 219
See application file for complete search history.

(56) References Cited

U.S. PATENT DOCUMENTS

| | | | | |
|---|---|---|---|---|
| 7,440,575 | B2 * | 10/2008 | Kirkeby | 381/1 |
| 7,725,324 | B2 * | 5/2010 | Bruhn et al. | 704/500 |
| 7,809,579 | B2 * | 10/2010 | Bruhn et al. | 704/500 |
| 2005/0226426 | A1 | 10/2005 | Oomen et al. | |
| 2006/0206319 | A1 * | 9/2006 | Taleb | 704/223 |
| 2007/0208565 | A1 * | 9/2007 | Lakaniemi et al. | 704/268 |
| 2008/0010072 | A1 | 1/2008 | Yoshida et al. | |
| 2009/0119111 | A1 | 5/2009 | Goto et al. | |

FOREIGN PATENT DOCUMENTS

EP 1818911 8/2007

(Continued)

OTHER PUBLICATIONS

Search report from E.P.O., mail date is Jan. 18, 2011.

(Continued)

*Primary Examiner* — Devona Faulk
*Assistant Examiner* — Disler Paul
(74) *Attorney, Agent, or Firm* — Greenblum & Bernstein, P.L.C.

(57) ABSTRACT

A scalable encoding device prevents sound quality deterioration of a decoded signal, reduces the encoding rate, and reduces the circuit size. The scalable encoding device includes a first layer encoder for generating a monaural signal by using a plurality of channel signals (L channel signal and R channel signal) constituting a stereo signal and encoding the monaural signal to generate a sound source parameter. The scalable encoding device also includes a second layer encoder for generating a first conversion signal by using the channel signal and the monaural signal, generating a synthesis signal by using the sound source parameter and the first conversion signal, and generating a second conversion coefficient index by using the synthesis signal and the first conversion signal.

20 Claims, 14 Drawing Sheets

FOREIGN PATENT DOCUMENTS

| | | |
|---|---|---|
| EP | 1953736 | 8/2008 |
| WO | 03/090207 | 10/2003 |

OTHER PUBLICATIONS

Goto et al., "Onsei Tsushinyo Stereo Onsei Fugoka Hoho no Kento", 2004 IEICE Engineering Sciences Society Taikai Koen Ronbunshu, A-6-6, p. 119 (Sep. 2004).

Ramprashad, S. A., "Stereophonic CELP Coding Using Cross Channel Prediction", Proc. IEEE Workshop on Speech Coding, pp. 136-138 (Sep. 2000).

ISO/IEC 14496-3:1999 (B.14 Scalable AAC with core coder).

U.S. Appl. No. 11/576,264 to Goto et al., filed Mar. 29, 2007.

U.S. Appl. No. 11/576,004 to Goto et al., filed Mar. 26, 2007.

U.S. Appl. No. 11/722,015 to Goto et al., filed Jun. 18, 2007.

* cited by examiner

SCALABLE ENCODING DEVICE AND SCALABLE ENCODING METHOD

TECHNICAL FIELD

The present invention relates to a scalable encoding apparatus and a scalable encoding method for encoding a stereo signal.

BACKGROUND ART

Like a call made using a mobile telephone, with speech communication in a mobile communication system, currently, communication using a monaural scheme (monaural communication) is mainstream. However, hereafter, like a fourth generation mobile communication system, if the transmission rate becomes a still higher bit rate, it is possible to ensure a bandwidth for transmitting a plurality of channels, so that it is expected that communication using a stereo scheme (stereo communication) will be also spread in speech communication.

For example, when the current situation is considered where the number of users increases who enjoy stereo music by recording music in a mobile audio player provided with a HDD (hard disc) and attaching earphones or headphones for stereo to the player, in the future, it is predicted that mobile telephones and music players will be linked together and a life style will be prevalent where speech communication is carried out using a stereo scheme utilizing equipment such as earphones and headphones for stereo. Further, in an environment such as video conference that has recently become widespread, in order to enable conversations having high-fidelity, it is predicted that stereo communication is performed.

On the other hand, in a mobile communication system and wired communication system, in order to reduce load of the system, it is typical to achieve a low bit rate of transmission information by encoding speech signals to be transmitted in advance. As a result, recently, a technique for coding stereo speech signals attracts attention. For example, there is a coding technique for increasing the coding efficiency for encoding predictive residual signals to which weight of CELP coding for stereo speech signals is assigned, using cross-channel prediction (refer to non-patent document 1).

Further, even if stereo communication becomes widespread, it is predicted that monaural communication will be still carried out. This is because monaural communication is performed at a low bit rate, and therefore it is expected that communication costs will decrease. Further, the circuit scale of mobile telephones supporting only monaural communication is small, and therefore such mobile telephones are inexpensive. Users that do not desire high-quality speech communication may therefore purchase mobile telephones supporting only monaural communication. As a result, in one communication system, there may be a mixture of mobile telephones supporting stereo communication and mobile telephones supporting monaural communication. It is therefore necessary for the communication system to support both stereo communication and monaural communication. Further, in a mobile communication system, communication data is exchanged using radio signals, and therefore there are cases where part of the communication data may be lost according to a channel environment. It is therefore extremely useful for mobile telephones to have a function capable of restoring original communication data from the remaining received data even if part of the communication data is lost.

As a function of supporting both stereo communication and monaural communication, and capable of restoring original communication data from the remaining received data even if part of the communication data is lost, there is scalable coding consisting of a stereo signal and a monaural signal. An example of the scalable encoding apparatus having this function is as disclosed, for example, in non-patent document 2.

Non-Patent Document 1: Ramprashad, S. A., "Stereophonic CELP coding using cross channel prediction", Proc. IEEE Workshop on Speech Coding, Pages: 136-138 (17-20 Sep. 2000)

Non-Patent Document 2: ISO/IEC 14496-3:1999 (B.14 Scalable AAC with core coder)

DISCLOSURE OF THE INVENTION

Problems to be Solved by the Invention

However, the art disclosed in non-patent document 1 has adaptive codebooks, fixed codebooks, and the like separately for two channel speech signals, generates excitation signals different between the channels, and generates a synthesis signal. Namely, CELP encoding is carried out on speech signals on a per channel basis, and the obtained encoded information of each channel is outputted to the decoding side. Therefore, there is a problem that encoded parameters corresponding to the number of channels are generated, the coding rate increases, and a circuit scale of the encoding apparatus also increases. Further, if the number of adaptive codebooks, fixed codebooks, and the like is reduced, the coding rate also decreases and the circuit scale is also reduced. However, inversely, speech quality of the decoded signal substantially deteriorates. This problem is also the same for the scalable encoding apparatus disclosed in non-patent document 2.

It is therefore an object of the present invention to provide a scalable encoding apparatus and a scalable encoding method capable of preventing deterioration of speech quality of a decoded signal, reducing the coding rate, and reducing the circuit scale.

Means for Solving the Problem

The scalable encoding apparatus of the present invention adopts a configuration having: a monaural signal generating section that generates a monaural signal using a plurality of channel signals constituting a stereo signal; a first encoding section that encodes the monaural signal and generates an excitation parameter; a monaural similar signal generating section that generates a first monaural similar signal using the channel signal and the monaural signal; a synthesizing section that generates a synthesis signal using the excitation parameter and the first monaural similar signal; and a second encoding section that generates a distortion minimizing parameter using the synthesis signal and the first monaural similar signal.

Advantageous Effect of the Invention

According to the present invention, it is possible to prevent deterioration of speech quality of a decoded signal, reduce the coding rate, and reduce the circuit scale of the encoding apparatus.

BEST MODE FOR CARRYING OUT THE INVENTION

Embodiments of the present invention will be described in detail below with reference to the accompanying drawings. Here, the case will be described as an example where a stereo speech signal comprised of two channels of an L channel and an R channel is encoded.

Embodiment 1

Figure 1:
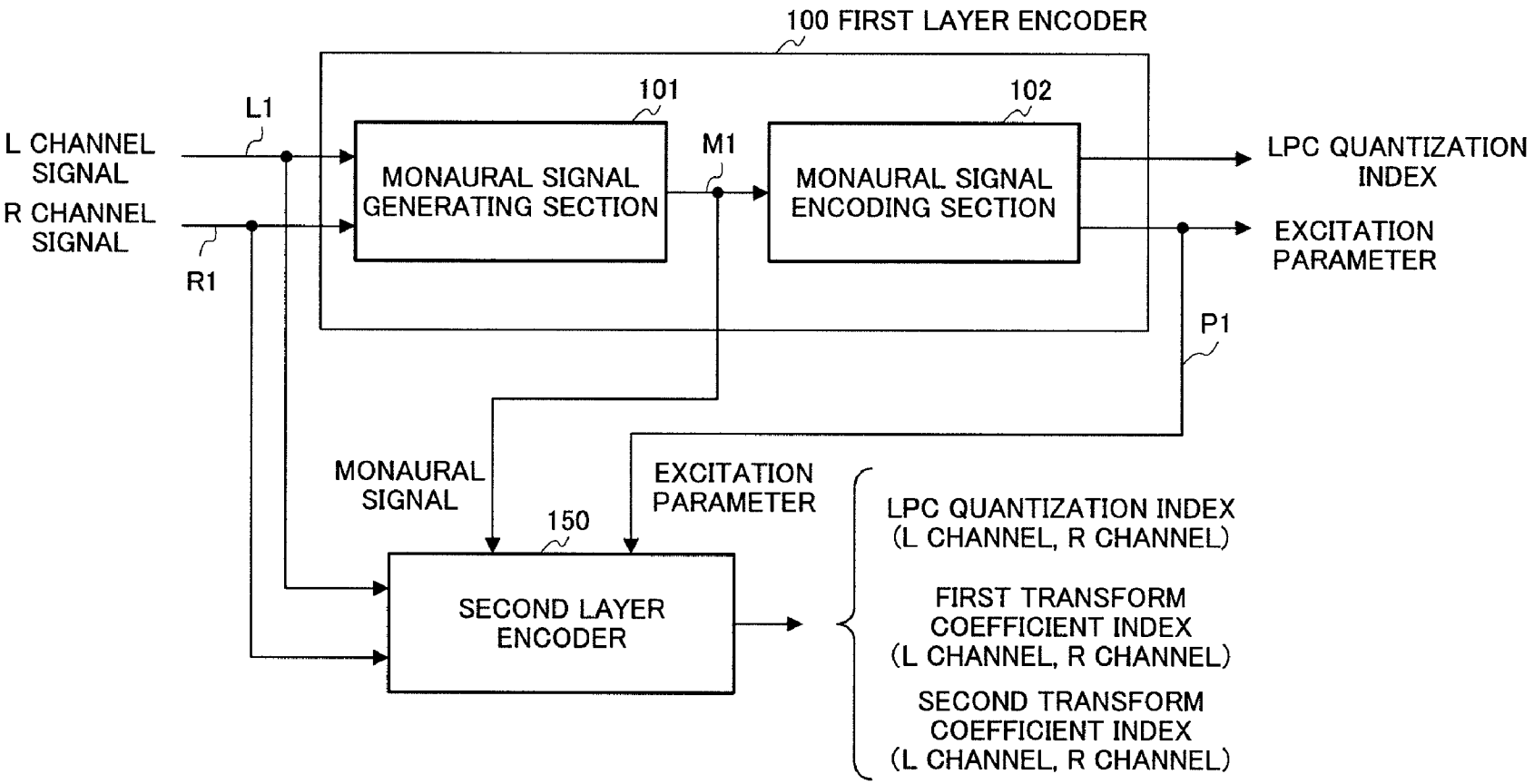
FIG. 1 is a block diagram showing the main configuration of a scalable encoding apparatus according to Embodiment 1.

FIG. 1 is a block diagram showing the main configuration of the scalable encoding apparatus according to Embodiment 1 of the present invention. Here, the case will be described as an example where CELP coding is used as a coding scheme of each layer.

The scalable encoding apparatus according to this embodiment has first layer encoder 100 and second layer encoder 150. A monaural signal is encoded at the first layer (base layer), a stereo signal is encoded at the second layer (enhancement layer), and encoded parameters obtained at each layer are transmitted to the decoding side.

More specifically, first layer encoder 100 generates monaural signal M1 from an inputted stereo speech signal—L channel signal L1 and R channel signal R1—at monaural signal generating section 101, and at monaural signal encoding section 102, encodes monaural signal M1, and obtains a encoded parameter (LPC quantization index) relating to vocal tract information and a encoded parameter (excitation parameter) relating to excitation information. The excitation parameter obtained at the first layer—excitation—may also be used at the second layer.

Second layer encoder 150 carries out first transform described later so as to generate a first transform signal and outputs a first transform coefficient so that waveforms of the L channel signal and R channel signal become similar to that of the monaural signal. Further, second layer encoder 150 carries out LPC analysis and LPC synthesis on the first transform signal using the excitation signal generated at the first layer. The details of this first transform will be described later.

Moreover, second layer encoder 150 carries out second transform on each LPC synthesis signal so that coding distortion of the first transform signal for these synthesis signals becomes a minimum, and encoded parameters of a second transform coefficient used in this second transform are outputted. This second transform is carried out by obtaining a codebook index using a closed loop search for each channel using a codebook. The details of this second transform will be also described later.

In this way, it is possible for the scalable encoding apparatus according to this embodiment to implement encoding at a low bit rate by sharing the excitation at the first layer and second layer.

Further, at the second layer, first transform is carried out so that the L channel signal and the R channel signal of the stereo signal have waveforms similar to that of a monaural signal. The excitation for CELP coding is then shared for the signal after first transform (first transform signal). Second transform is independently performed on each channel so that coding distortion for the first transform signal of the LPC synthesis signal of each channel becomes a minimum. By this means, it is possible to improve speech quality.

Figure 2:
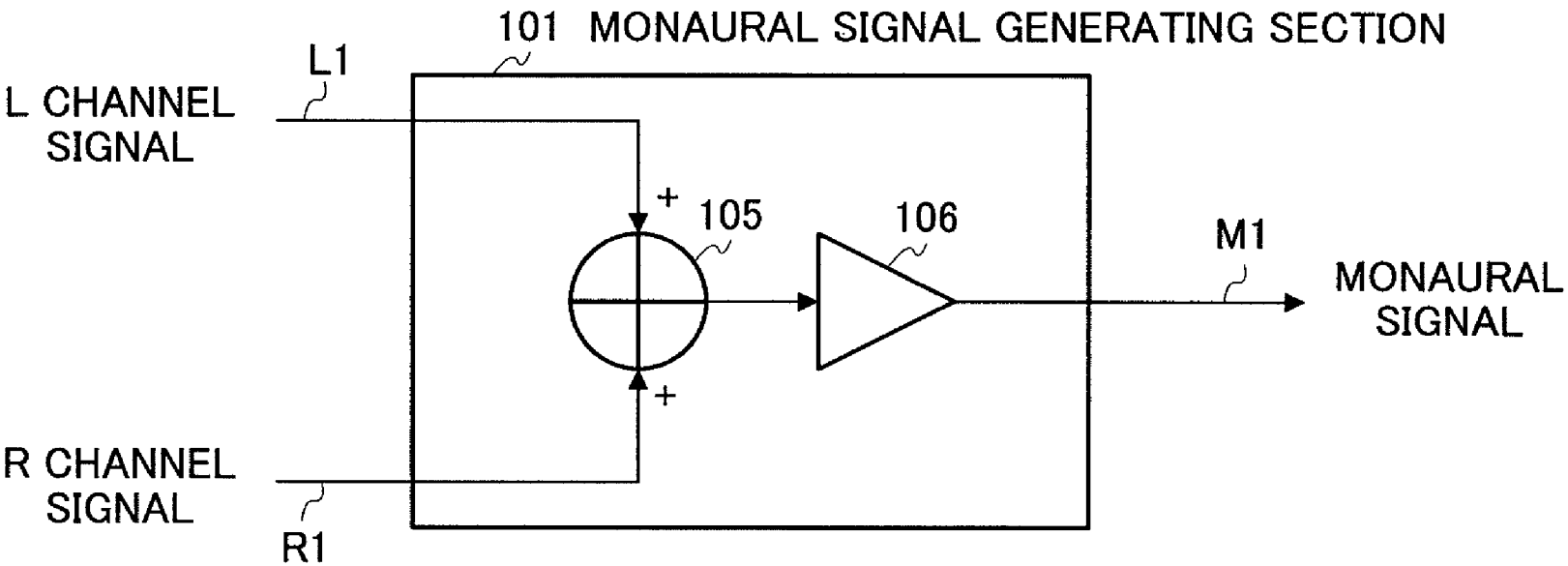
FIG. 2 is a block diagram showing the main internal configuration of a monaural signal generating section according to Embodiment 1.

FIG. 2 is a block diagram showing the main internal configuration of monaural signal generating section 101.

Monaural signal generating section 101 generates monaural signal M1 having intermediate properties of both signals of inputted L channel signal L1 and R channel signal R1 and outputs monaural signal M1 to monaural signal encoding section 102. As a specific example, an average of L channel signal L1 and R channel signal R1 is taken to be M1. In this case, as shown in FIG. 2, adder 105 obtains the sum of L channel signal L1 and R channel signal R1. Multiplier 106 then sets the scale of this sum signal to be ½ and outputs this signal as monaural signal M1.

Figure 3:
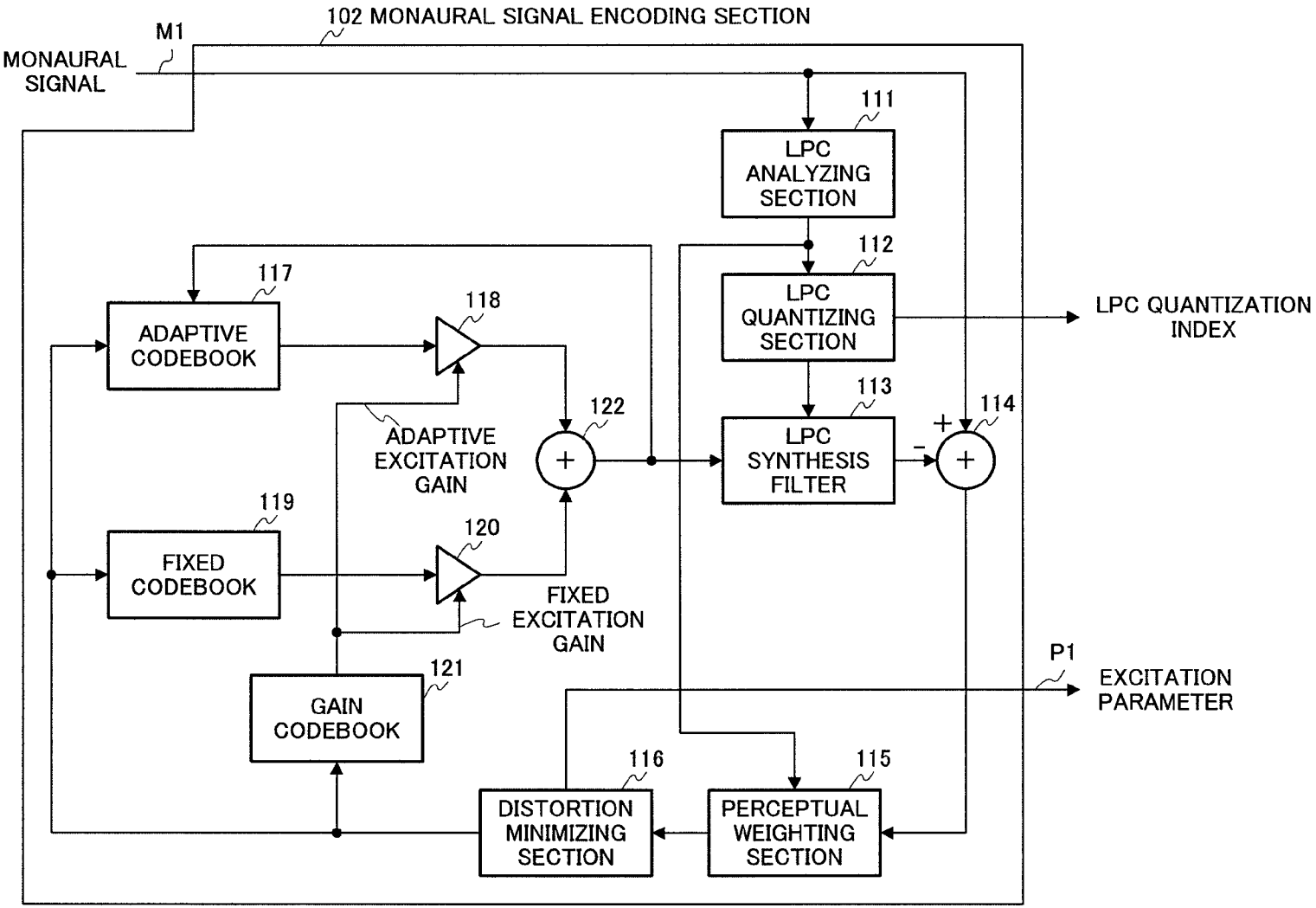
FIG. 3 is a block diagram showing the main internal configuration of a monaural signal encoding section according to Embodiment 1.

FIG. 3 is a block diagram showing the main internal configuration of monaural signal encoding section 102.

Monaural signal encoding section 102 is provided with LPC analyzing section 111, LPC quantizing section 112, LPC synthesis filter 113, adder 114, perceptual weighting section 115, distortion minimizing section 116, adaptive codebook 117, multiplier 118, fixed codebook 119, multiplier 120, gain codebook 121 and adder 122. Monaural signal encoding section 102 carries out CELP coding and outputs excitation parameters (adaptive codebook index, fixed codebook index and gain codebook index) and an LPC quantization index.

LPC analyzing section 111 performs linear prediction analysis on monaural signal M1, and outputs LPC parameters that are the results of analysis to LPC quantizing section 112 and perceptual weighting section 115. LPC quantizing section 112 quantizes the LPC parameters, and outputs an index (LPC quantization index) specifying the obtained quantized LPC parameters. This index is then normally outputted to outside of the scalable encoding apparatus according to this embodiment. Further, LPC quantizing section 112 then outputs the quantized LPC parameters to LPC synthesis filter 113. LPC synthesis filter 113 uses quantized LPC parameters outputted from LPC quantizing section 112 and carries out synthesis using an LPC synthesis filter taking the excitation vector generated using adaptive codebook 117 and fixed codebook 119 described later as an excitation. The obtained synthesis signal is then outputted to adder 114.

Adder 114 then calculates an error signal by subtracting the synthesis signal outputted from LPC synthesis filter 113 from monaural signal M1 and outputs this error signal to perceptual weighting section 115. This error signal corresponds to coding distortion. Perceptual weighting section 115 performs perceptual weighting on the coding distortion using a perceptual weighting filter configured based on LPC parameters outputted from LPC analyzing section 111 and outputs the result to distortion minimizing section 116. Distortion minimizing section 116 instructs adaptive codebook 117, fixed codebook 119 and gain codebook 121 of the index to be used so that coding distortion becomes a minimum.

Adaptive codebook 117 stores excitation vectors for excitation to LPC synthesis filter 113 generated in the past in an internal buffer, generates an excitation vector corresponding to one subframe from excitation vectors stored therein based on adaptive codebook lag corresponding to the index instructed by distortion minimizing section 116 and outputs the excitation vector as an adaptive excitation vector to multiplier 118. Fixed codebook 119 outputs the excitation vector corresponding to the index instructed by distortion minimizing section 116 to multiplier 120 as a fixed excitation vector. Gain codebook 121 generates gains for the adaptive excitation vector and fixed excitation vector. Multiplier 118 multiplies the adaptive excitation gain outputted from gain codebook 121 with the adaptive excitation vector, and outputs the result to adder 122. Multiplier 120 multiplies fixed excitation gain outputted from gain codebook 121 with the fixed excitation vector, and outputs the result to adder 122. Adder 122 then adds the adaptive excitation vector outputted from multiplier 118 and the fixed excitation vector outputted from multiplier 120, and outputs an excitation vector after addition as an excitation to LPC synthesis filter 113. Further, adder 122 feeds back the obtained excitation vector of excitation to adaptive codebook 117.

LPC synthesis filter 113 uses the excitation vector outputted from adder 122—excitation vector generated using adaptive codebook 117 and fixed codebook 119—as an excitation and carries out synthesis, as described above.

In this way, the series of processing for obtaining coding distortion using the excitation vector generated by adaptive codebook 117 and fixed codebook 119 constitutes a closed loop (feedback loop). Distortion minimizing section 116 then instructs adaptive codebook 117, fixed codebook 119 and gain codebook 121 so that this coding distortion becomes a minimum. Distortion minimizing section 116 then outputs various excitation parameters so that coding distortion becomes a minimum. The parameters are then normally outputted to outside of the scalable encoding apparatus according to this embodiment.

Figure 4:
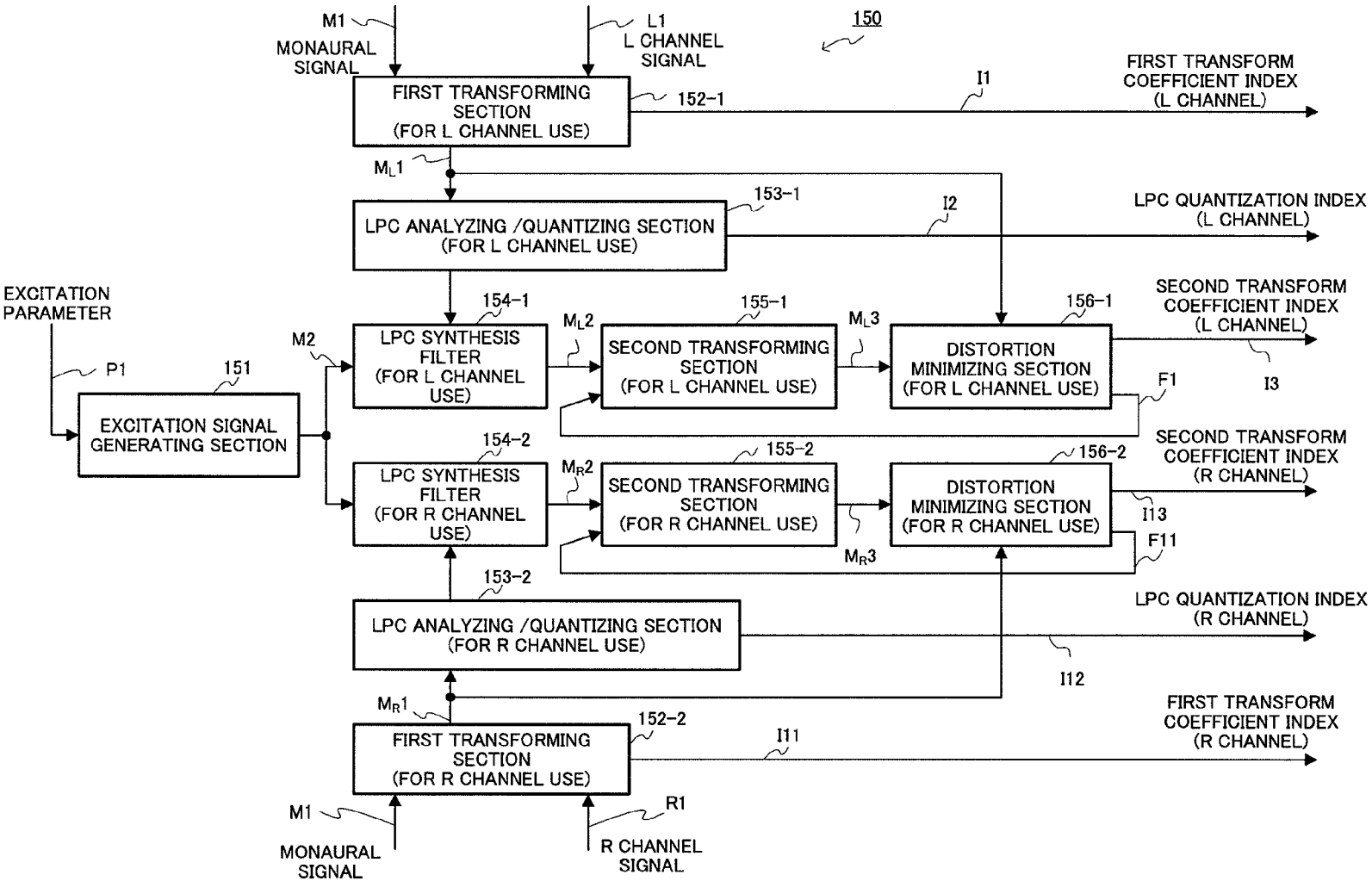
FIG. 4 is a block diagram showing the main internal configuration of a second layer encoder according to Embodiment 1.

FIG. 4 is a block diagram showing the main internal configuration of second layer encoder 150.

Second layer encoder 150 is comprised of an L channel processing system for processing an L channel of a stereo speech signal and an R channel processing system for processing an R channel of a stereo speech signal, and the two systems have the same configuration. Components that are the same for both channels will be assigned the same reference numerals, and a hyphen followed by branch number 1 will be assigned to the L channel processing system, and a hyphen followed by a branch number 2 will be assigned to the R channel processing system. Only the L channel processing system will be described, and a description for the R channel processing system will be omitted. Excitation signal generating section 151 is shared by the L channel and the R channel.

The L channel processing system of second layer encoder 150 has excitation signal generating section 151, first transforming section 152-1, LPC analyzing/quantizing section 153-1, LPC synthesis filter 154-1, second transforming section 155-1 and distortion minimizing section 156-1.

Excitation signal generating section 151 then generates excitation signal M2 common to the L channel and R channel using excitation parameter P1 outputted from first layer encoder 100.

First transforming section 152-1 acquires a first transform coefficient indicating a difference in characteristics of a waveform between L channel signal L1 and monaural signal M1 from L channel signal L1 and monaural signal M1, performs first transform on L channel signal L1 using this first transform coefficient, and generates first transform signal $M_L$1 similar to monaural signal M1. Further, first transforming section 152-1 then outputs index I1 (first transform coefficient index) specifying the first transform coefficient.

LPC analyzing/quantizing section 153-1 then performs linear predictive analysis on first transform signal $M_L$1, obtains an LPC parameter that is spectral envelope information, quantizes this LPC parameter, outputs the obtained quantized LPC parameter to LPC synthesis filter 154-1, and outputs index (LPC quantization index) I2 specifying the quantized LPC parameter.

LPC synthesis filter 154-1 takes the quantized LPC parameter outputted from LPC analyzing/quantizing section 153-1 as a filter coefficient, and takes excitation vector M2 generated within excitation signal generating section 151 as an excitation, and generates synthesis signal $M_L$2 for the L channel using an LPC synthesis filter. This synthesis signal $M_L$2 is outputted to second transforming section 155-1.

Second transforming section 155-1 performs second transform described later on synthesis signal $M_L$2 and outputs second transform signal $M_L$3 to distortion minimizing section 156-1.

Distortion minimizing section 156-1 controls second transform at second transforming section 155-1 using feedback signal F1 so that coding distortion of second transform signal $M_L$3 becomes a minimum, and outputs index (second transform coefficient index) I3 specifying the second transform coefficient which minimizes the coding distortion. First transform coefficient index I1, LPC quantization index I2, and second transform coefficient index I3 are outputted to outside of the scalable encoding apparatus according to this embodiment.

Next, the operation of each section in second layer encoder 150 will be described in detail.

Figure 5:
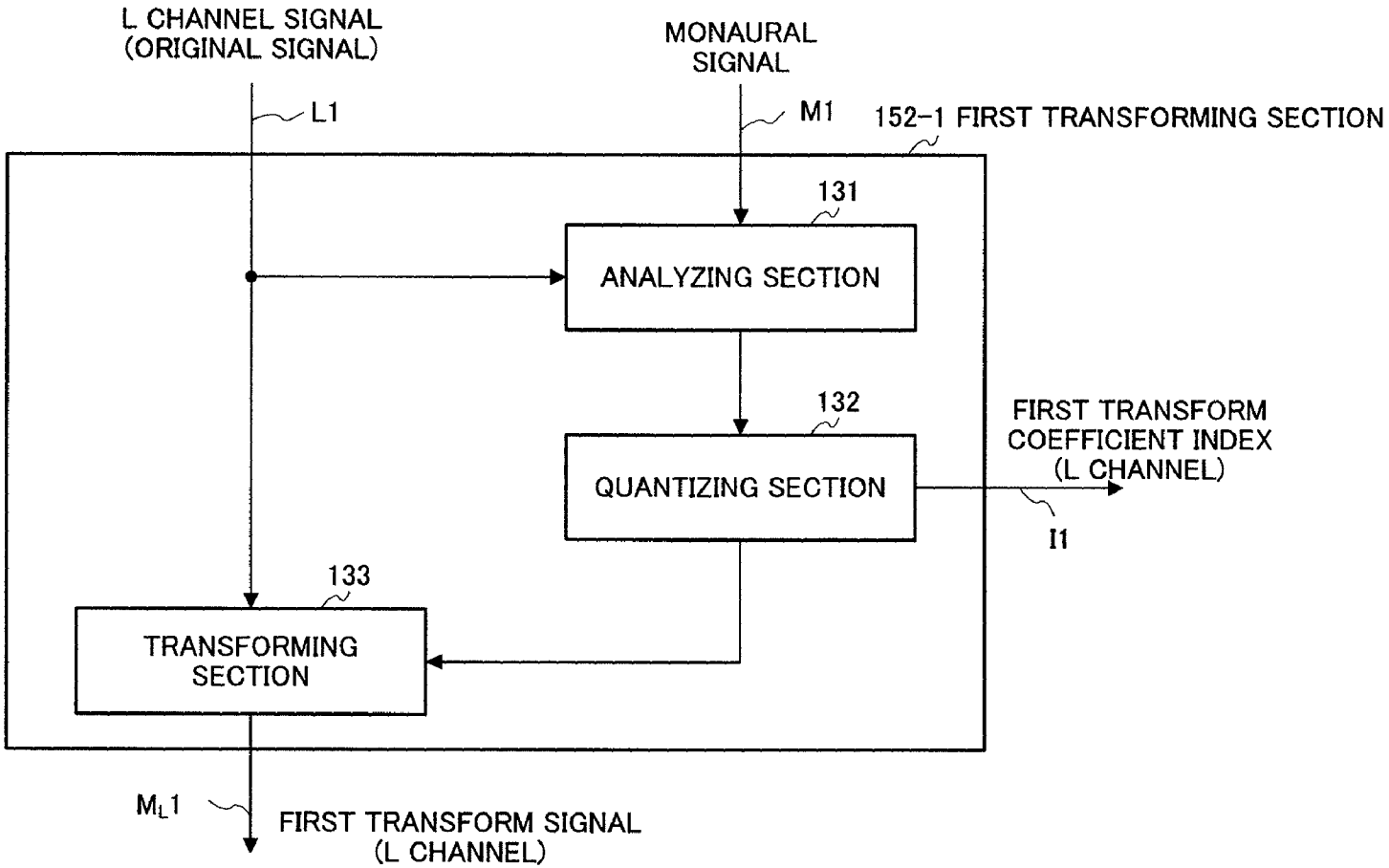
FIG. 5 is a block diagram showing the main internal configuration of a first transforming section according to Embodiment 1.

FIG. 5 is a block diagram showing the main internal configuration of first transforming section 152-1. First transforming section 152-1 is provided with analyzing section 131, quantizing section 132 and transforming section 133.

Analyzing section 131 obtains a parameter (waveform difference parameter) indicating a difference in the waveform of L channel signal L1 with respect to monaural signal M1 by comparing and analyzing the waveform of L channel signal L1 and the waveform of monaural signal M1. Quantizing section 132 quantizes the waveform difference parameter, and outputs the obtained encoded parameter—first transform coefficient index I1—to outside of the scalable encoding apparatus according to this embodiment. Further, quantizing section 132 performs inverse quantization on first transform coefficient index I1 and outputs the result to transforming section 133. Transforming section 133 transforms L channel signal L1 to signal $M_L$1 having a waveform similar to monaural signal M1 by removing from L channel signal L1 the inverse-quantized first transform coefficient index outputted from quantizing section 132—a waveform difference parameter (including the case where a quantization error is included) between the two channels obtained by analyzing section 131.

Here, the waveform difference parameter indicates the difference in characteristic of the waveforms between the L channel signal and monaural signal, specifically, indicates an amplitude ratio (energy ratio) and/or delay time difference of the L channel signal with respect to a monaural signal using the monaural signal as a reference signal.

Typically, the waveform of the signal exhibits different characteristics depending on the position where the microphone is located even for stereo speech signals or stereo audio signals from the same generation source. As a simple example, energy of a stereo signal is attenuated according to the distance from the generation source, delays also occur in the arrival time, and waveform spectrum becomes different depending on the sound pick-up position. In this way, the stereo signal is substantially influenced by spatial factors such as a pick-up environment.

Figure 6:
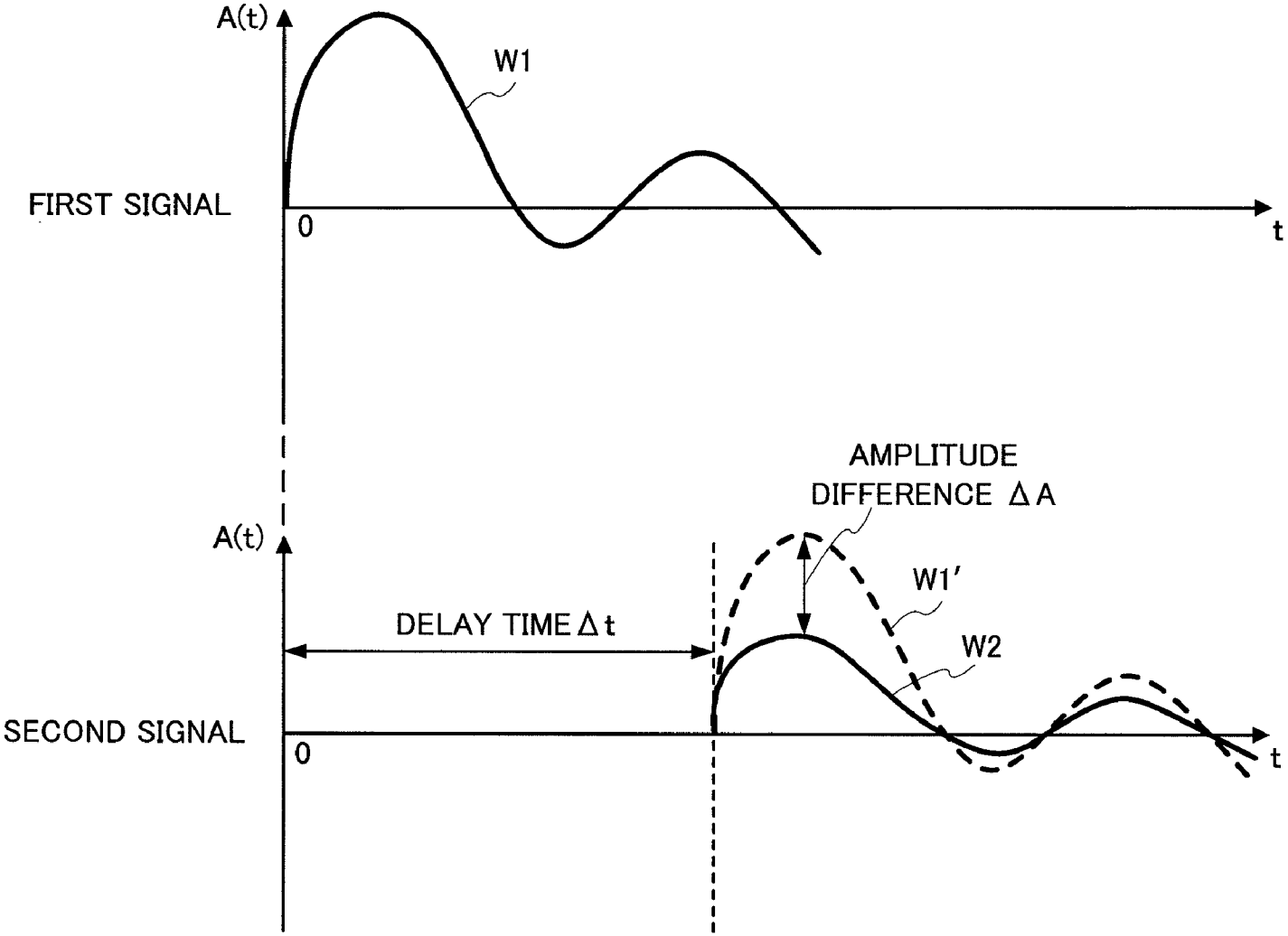
FIG. 6 shows an example of a waveform spectrum of signals from the same generation source, acquired at different positions.

An example of a speech waveform of signals (first signal W1, second signal W2) from the same generation source, acquired at two different positions, is shown in FIG. 6 in order to describe in detail characteristics of stereo signals according to the differences in the pick-up environment.

As shown in the drawings, it can be seen that the first signal and the second signal have different characteristics. This is because different new spatial characteristic (spatial information) is added to the waveform of the original signal according to the acquired position and the signal is acquired by a pick-up equipment such as a microphone. In this application, parameters exhibiting this characteristic are particularly referred to as "waveform difference parameters". For example, in the example in FIG. 6, when first signal W1 is delayed by just time Δt, signal W1' is obtained. Next, if the amplitude of signal W1' is reduced by a fixed rate so that amplitude difference ΔA is eliminated, signal W1' is a signal from the same generation source, and therefore is expected to ideally match with second signal W2. Namely, it is possible to remove differences in the characteristics between the first signal and the second signal by performing processing for operating characteristics of the waveform included in the speech signal or audio signal. It is therefore possible to make the waveforms of both stereo signals similar.

First transforming section 152-1 shown in FIG. 5 obtains a waveform difference parameter of L channel signal L1 with respect to monaural signal M1, and obtains first transform signal $M_L$1 similar to monaural signal M1 by separating the waveform difference parameter from L channel signal L1, and also encodes the waveform difference parameter.

Next, a specific method for deriving the first transform coefficient will be described in detail using mathematical expressions. First, the case will be described as an example where the energy ratio and delay time difference between the two channels are used as the waveform difference parameter.

Analyzing section 131 calculates an energy ratio in a frame unit between two channels. First, energy $E_{Lch}$ and $E_M$ within one frame of the L channel signal and monaural signal can be obtained according to the following equation 1 and equation 2.

[1]

$$E_{Lch} = \sum_{n=0}^{FL-1} x_{Lch}(n)^2 \quad \text{(Equation 1)}$$

[2]

$$E_M = \sum_{n=0}^{FL-1} x_M(n)^2 \quad \text{(Equation 2)}$$

Here, n is a sample number, and FL is the number of samples in one frame (frame length). Further, $x_{Lch}(n)$ and $x_M(n)$ indicate amplitudes of the nth samples of L channel signal and monaural signal, respectively.

Analyzing section 131 then obtains square root C of the energy ratio of the L channel signal and monaural signal according to the following equation 3.

[3]

$$C = \sqrt{\frac{E_{Lch}}{E_M}} \quad \text{(Equation 3)}$$

Further, analyzing section 131 obtains a delay time difference that is an amount of time shift of the L channel signal with respect to the monaural signal as a value where cross-correlation between two channel signals becomes a maximum. Specifically, cross-correlation function Φ for the monaural signal and the L channel signal can be obtained according to the following equation 4.

[4]

$$\phi(m) = \sum_{n=0}^{FL-1} x_{Lch}(n) \cdot x_M(n-m) \quad \text{(Equation 4)}$$

Here, m is assumed to be a value in the predetermined range from mim_m to max_m, and m=M when Φ(m) is a maximum is assumed to be a delay time of the L channel signal with respect to the monaural signal.

The above-described energy ratio and delay time difference may also be obtained using the following equation 5. In equation 5, energy ratio square root C and delay time m are obtained so that error D between the monaural signal and the L channel signal where the waveform difference parameter is removed from the monaural signal, becomes a minimum.

[5]

$$D = \sum_{n=0}^{FL-1} \{x_{Lch}(n) - C \cdot x_M(n-m)\}^2 \quad \text{(Equation 5)}$$

Quantizing section 132 quantizes the above-described C and M using a predetermined number of bits and takes quantized values C and M as $C_Q$ and $M_Q$, respectively.

Transforming section 133 removes the energy difference and time delay difference between the L channel signal and the monaural signal from the L channel signal according to the transform equation of the following equation 6.

[6]

$$x_{Lch}'(n)=C_Q \cdot x_{Lch}(n-M_Q) \quad \text{(Equation 6)}$$

(where, n=0, . . . , FL−1)

Further, specific examples of the above-described waveform difference parameters are as follows.

For example, it is also possible to use two parameters of energy ratio and delay time difference between the two channels as a waveform difference parameter. These parameters are easy to quantify. Further, it is possible to use channel characteristics such as, for example, phase difference and amplitude ratio of each frequency band as variation.

Further, it is also possible to use only one of the parameters as the waveform difference parameter without taking both of the two parameters of energy ratio and time delay difference between the two channels (for example, the L channel signal and monaural signal) as the waveform difference parameter. When only one parameter is used, the effect of increasing similarity between the two channels is reduced compared to the case where two parameters are used, but inversely there is the effect that the number of coding bits can be further reduced.

For example, when only energy ratio between two channels is used as a waveform difference parameter, the L channel signal is transformed according to the following equation 7 using value $C_Q$ obtained by quantizing square root C of the energy ratio obtained using the above-described equation 3.

[7]

$$x_{Lch}'(n)=C_Q \cdot x_{Lch}(n) \quad \text{(Equation 7)}$$

(where, n=1, . . . , FL−1)

For example, when only delay time difference between two channels is used as a waveform difference parameter, the L channel signal is transformed according to the following equation 8 using value $M_Q$ obtained by quantizing m=M where Φ(m) obtained using the above-described equation 4 becomes a maximum.

[8]

$$x_{Lch}'(n)=x_{Lch}(n-M_Q) \quad \text{(Equation 8)}$$

(where, n=0, . . . , FL−1)

Figure 7:
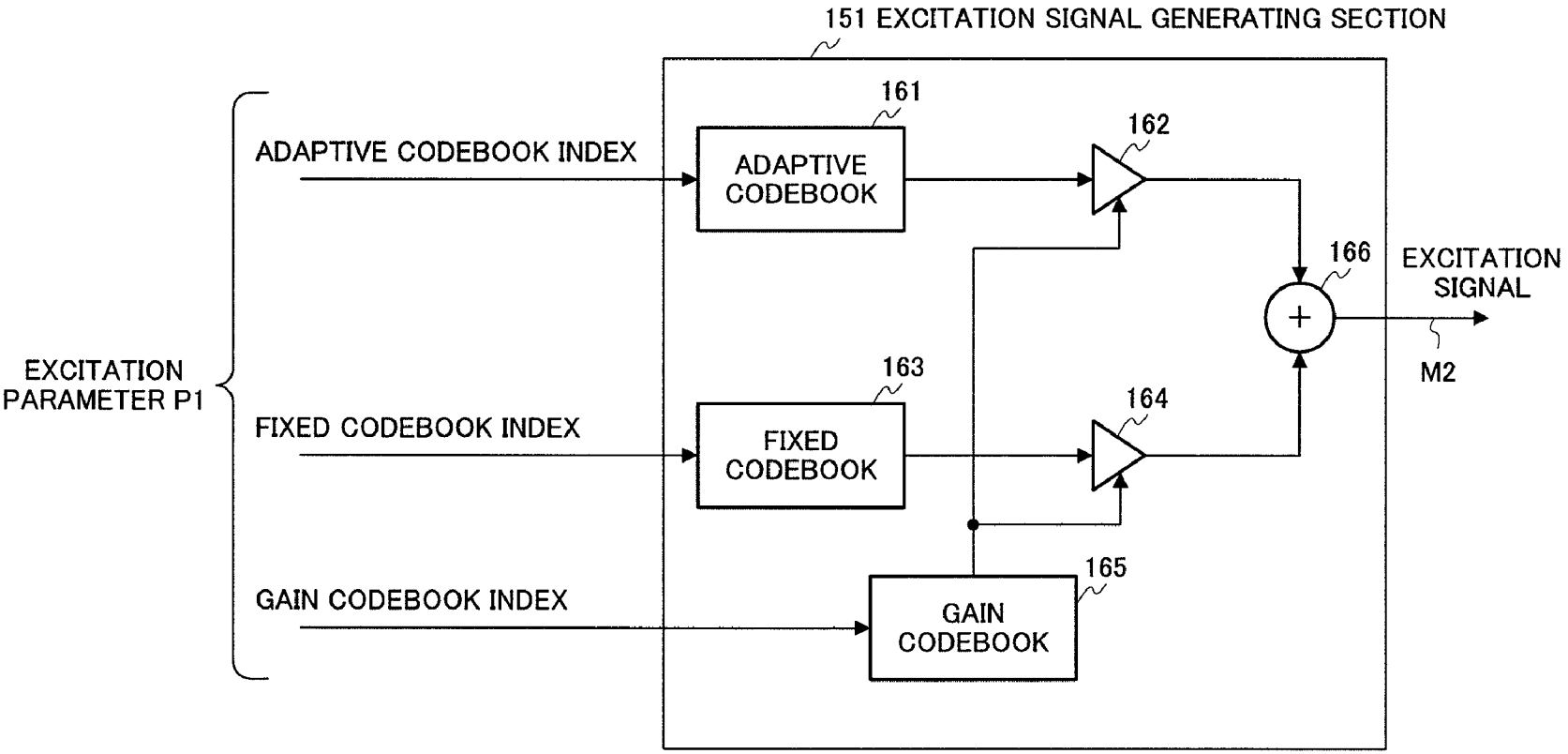
FIG. 7 is a block diagram showing the main internal configuration of an excitation generating section according to Embodiment 1.

FIG. 7 is a block diagram showing the main internal configuration of excitation signal generating section 151.

Adaptive codebook 161 obtains a corresponding codebook lag from the adaptive codebook index of excitation parameter P1 outputted from monaural signal encoding section 102, generates an excitation vector corresponding to one subframe from the excitation vectors stored in advance based on this adaptive codebook, and outputs the excitation vector to multiplier 162 as an adaptive excitation vector.

Fixed codebook 163 outputs an excitation vector corresponding to this codebook index as a fixed excitation vector to multiplier 164 using a fixed codebook index of excitation parameter P1 outputted from monaural signal encoding section 102.

Gain codebook 165 then generates each gain for the adaptive excitation vector and fixed excitation vector using the gain codebook index of excitation parameter P1 outputted from monaural signal encoding section 102.

Multiplier 162 multiplies adaptive excitation gain outputted from gain codebook 165 with the adaptive excitation vector and outputs the result to adder 166. Multiplier 164 similarly multiplies the fixed excitation gain outputted from gain codebook 165 with the fixed excitation vector and outputs the result to adder 166.

Adder 166 adds excitation vectors outputted from multiplier 162 and multiplier 164, and outputs excitation vector (excitation signal) M2 after addition as an excitation to LPC synthesis filter 154-1 (and LPC synthesis filter 154-2).

Next, the operation of second transforming section 155-1 will be described. Second transforming section 155-1 performs following second transform.

Second transforming section 155-1 performs second transform on the synthesis signal outputted from LPC synthesis filter 154-1. This second transform transforms the synthesis signal outputted from LPC synthesis filter 154-1 to be similar to first transform signal $M_L$1 outputted from first transforming section 152-1. Namely, as a result of the second transform, the signal after the second transform becomes a signal similar to first transform signal $M_L$1. Second transforming section 155-1 obtains transform coefficients using a closed loop search from a codebook of transform coefficients prepared in advance within second transforming section 155-1 so as to implement the above-described transform under the control of distortion minimizing section 156-1.

Specifically, the second transform is carried out according to the following equation 9.

[9]

$$SP_j(n) = \sum_{k=-KB}^{KF} \alpha_j(k) \cdot S(n-k) \quad \text{(Equation 9)}$$

(where, $n = 0, \ldots, SFL-1$)

Here, S(n−k) is the synthesis signal outputted from LPC synthesis filter 154-1, and $SP_j(n)$ is a signal after the second transform. Further, $\alpha_j(k)$ (where k=−KB to KF) is a jth second transform coefficient, and $N_{cb}$ (where j=0 to $N_{cb-1}$) coefficient streams are prepared in advance as a codebook. SFL is a subframe length. The above-described equation 9 is calculated for each of these sets.

Distortion minimizing section 156-1 calculates difference signal $DF_j(n)$ between signal S' (n) which is the first transform signal $M_L$1 and $SP_j(n)$ (n=0 to SFL−1) according to the following equation 10.

[10]

$$DF_j(n)=S'(n)-SP_j(n) \quad \text{(Equation 10)}$$

(where, n=0, . . . , SFL−1)

Here, coding distortion after assigning perceptual weights to difference signal $DF_j(n)$ is taken as coding distortion for the scalable encoding apparatus according to this embodiment. This calculation is carried out on all sets of second transform coefficients $\{\alpha_j(k)\}$, and the second transform coefficients are decided so that coding distortion for the L channel signal and R channel signal becomes a minimum. The series of processing for obtaining coding distortion of this signal configure a closed loop (feedback loop). By changing the second transform coefficient within one subframe, the actually obtained index (second transform coefficient index) indicating a set of second transform coefficients which minimizes coding distortion is then outputted.

Figure 8:
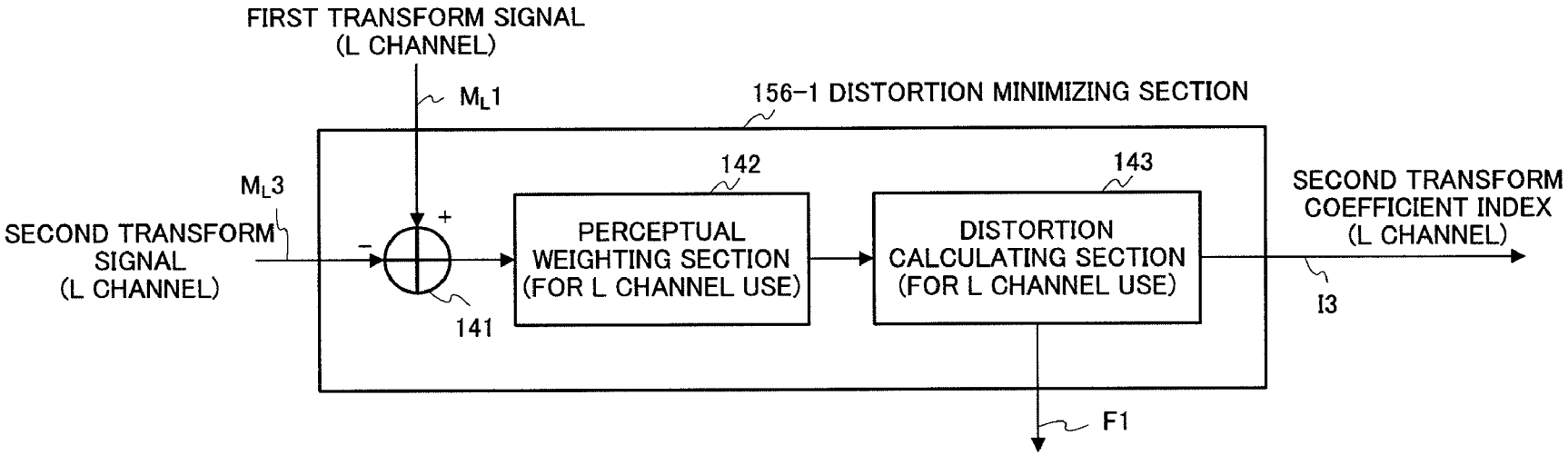
FIG. 8 is a block diagram showing the main internal configuration of a distortion minimizing section according to Embodiment 1.

FIG. 8 is a block diagram showing the main internal configuration of distortion minimizing section 156-1.

Adder 141 calculates an error signal by subtracting second transform signal $M_L$3 from first transform signal $M_L$1, and outputs this error signal to perceptual weighting section 142.

Perceptual weighting section 142 then assigns perceptual weights to the error signal outputted from adder 141 using the perceptual weighting filter and outputs the result to distortion calculating section 143.

Distortion calculating section 143 controls second transforming section 155-1 using feedback signal F1 on a per subframe basis so that coding distortion obtained from the error signal outputted from perceptual weighting section 142 after the perceptual weights are assigned becomes a minimum. Distortion calculating section 143 then outputs second transform coefficient index l3 which minimizes coding distortion of second transform signal $M_L$3. The parameter is then normally outputted to outside of the scalable encoding apparatus according to this embodiment as a encoded parameter.

Figure 9:
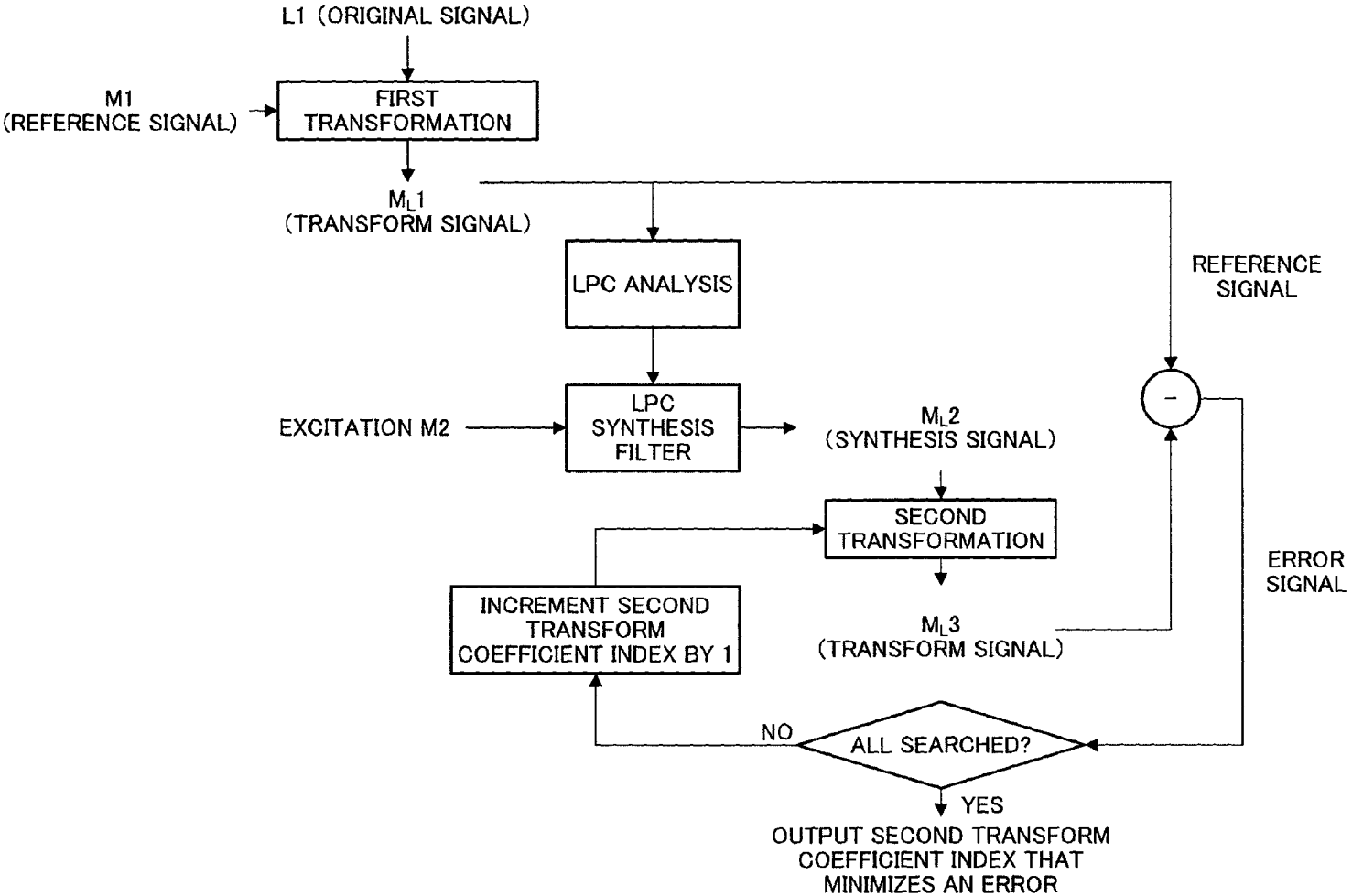
FIG. 9 summarizes an outline of encoding processing for an L channel processing system.

FIG. 9 summarizes an outline of coding processing of the above-described L channel processing system. A principle will be described using this drawing for reducing a coding rate and increasing coding accuracy using the scalable encoding method according to this embodiment.

With L channel coding, signal L1 that is the original signal for the L channel is normally taken as a coding target. However, with the L channel processing system described above, signal L1 is not directly used, but signal L1 is transformed to signal (monaural similar signal) $M_L$1 similar to monaural signal M1, and this transformed signal is taken as a coding target. If signal $M_L$1 is taken as a coding target, it is possible to carry out encoding processing using the configuration upon encoding of the monaural signal, that is, it is possible to encode the L channel signal using a method conforming to encoding of a monaural signal.

Specifically, with the L channel processing system, synthesis signal $M_L$2 is generated for monaural similar signal $M_L$1 using monaural signal excitation M2, and a encoded parameter for minimizing the error of this synthesis signal is obtained.

Further, in this embodiment, by taking monaural similar signal $M_L$1 as the coding target of the L channel processing system that is the second layer, items (such as encoded parameter and excitation signal) already obtained using the first layer can be effectively utilized, and the second layer coding can be carried out. This is because the coding target of the first layer is a monaural signal.

Specifically, the excitation generated (for a monaural signal) previously at the first layer is utilized upon generation of synthesis signal $M_L$2 at the second layer. As a result, it is possible to reduce a coding rate because the excitation is shared by the first layer and the second layer.

In particular, in this embodiment, second layer encoding is carried out using the excitation generated by monaural signal encoding section 102 out of the items already obtained in the first layer. Namely, out of excitation information and vocal tract information, only excitation information already obtained at the first layer may be utilized.

For example, with the AMR-WB scheme (23.85 kbit/s) disclosed in TS26.190 V5.1.0 (2001-12) of the 3GPP specification, the information amount of the excitation information is approximately seven times of that of the vocal tract information, and the bit rate of the excitation information after encoding is also greater than that of the vocal tract information. The effects of reducing a coding rate are larger when the excitation information is shared by the first layer and second layer rather than when the vocal tract information is shared.

Moreover, sharing is more advantageous for excitation information than for vocal tract information for the reasons specific to stereo speech signals described below.

A stereo signal is sound that comes from a specific generation source and is picked up at the same timing from two microphones separated, for example, into left and right. This means that ideally, each channel signal has common excitation information. In reality, if there is a single generation source of sound (or, even if there are a plurality of generation sources, the generation sources are close to each other and can be seen as a single generation source), it is possible to carry out processing assuming that the excitation information of each channel is common.

However, when a plurality of generation sources exist at positions separated from each other, a plurality of sounds generated at generation sources arrive at the microphones at different timings (delay time is different) and the degree of attenuation is also different according to a difference in channels. Therefore, sounds actually picked up at the microphones are sounds mixed in a complex state where each excitation information is difficult to separate.

It can be considered that the above characteristic phenomena is a result of new spatial characteristics being added to the sound according to differences in the pick-up environment. In doing so, out of the vocal tract information and excitation information of the stereo speech signal, the vocal tract information is substantially influenced by differences in the pick-up environment, and the excitation information is not influenced so much. This is because the vocal tract information, which may also be referred to as spectral envelope information, is mainly information relating to the waveform of the speech spectrum, and spatial characteristics newly added to sounds according to differences in the sound pick-up environment are also characteristics relating to the waveform such as an amplitude ratio and a delay time.

As a result, it is expected that there will not be substantial quality deterioration even if the excitation information is shared between the monaural signal (first layer) and the L channel/R channel signal (second layer). Namely, it is expected that coding efficiency improves by sharing the excitation information by the first layer and second layer and processing the vocal tract information on a per channel basis, and it is possible to reduce a coding rate.

Therefore, in this embodiment, for the excitation information, the excitation generated by monaural signal encoding section 102 is inputted to both L channel LCP synthesis filter 154-1 and R channel LPC synthesis filter 154-2. Further, for the vocal tract information, LPC analyzing/quantizing section 153-1 is provided for the L channel, and LPC analyzing/quantizing section 153-2 is provided for the R channel, and linear predictive analysis is independently carried out on a per channel basis (refer to FIG. 4). Namely, encoding is carried out as a model where spatial characteristics added according to differences in the pick-up environment are included in the encoded parameter of the vocal tract information.

On the other hand, new problems arise as a result of adopting the above configuration. For example, when a description is given focusing on the L channel, excitation M2 used by the L channel processing system is obtained for the monaural signal. As a result, when encoding of the L channel is carried out using this excitation M2, monaural information is mixed into the L channel, and L channel coding accuracy therefore deteriorates. When monaural similar signal $M_L$1 is taken as a coding target, in the first transform, a waveform of original signal L1 is only mathematically (by addition, subtraction, multiplication and division) processed, and therefore it does not become a substantial problem. This is because, for example, it is possible to perform inverse transform for restoring original signal L1 from the transformed signal $M_L$1, and it is substantially the same from the viewpoint of coding accuracy if $M_L$1 or L1 is taken as a coding target.

In this embodiment, optimization (second transform) is carried out so that synthesis signal $M_L$2 generated based on excitation M2 becomes close to $M_L$1. It is therefore possible to increase coding accuracy for the L channel even if an excitation for the monaural signal is used.

Specifically, the L channel processing system performs second transform on synthesis signal $M_L$2 generated based on excitation M2 and generates transform signal $M_L$3. The second transform coefficient is then adjusted so that transform signal $M_L$3 becomes close to $M_L$1 taking $M_L$1 as a reference signal. More specifically, the processing of the second transform and later configures a loop. The L channel processing system then calculates errors between $M_L$1 and $M_L$3 for all indexes by incrementing the index indicating the second transform coefficient one at a time and outputs an index for the second transform coefficient that minimizes the final error.

Figure 10:
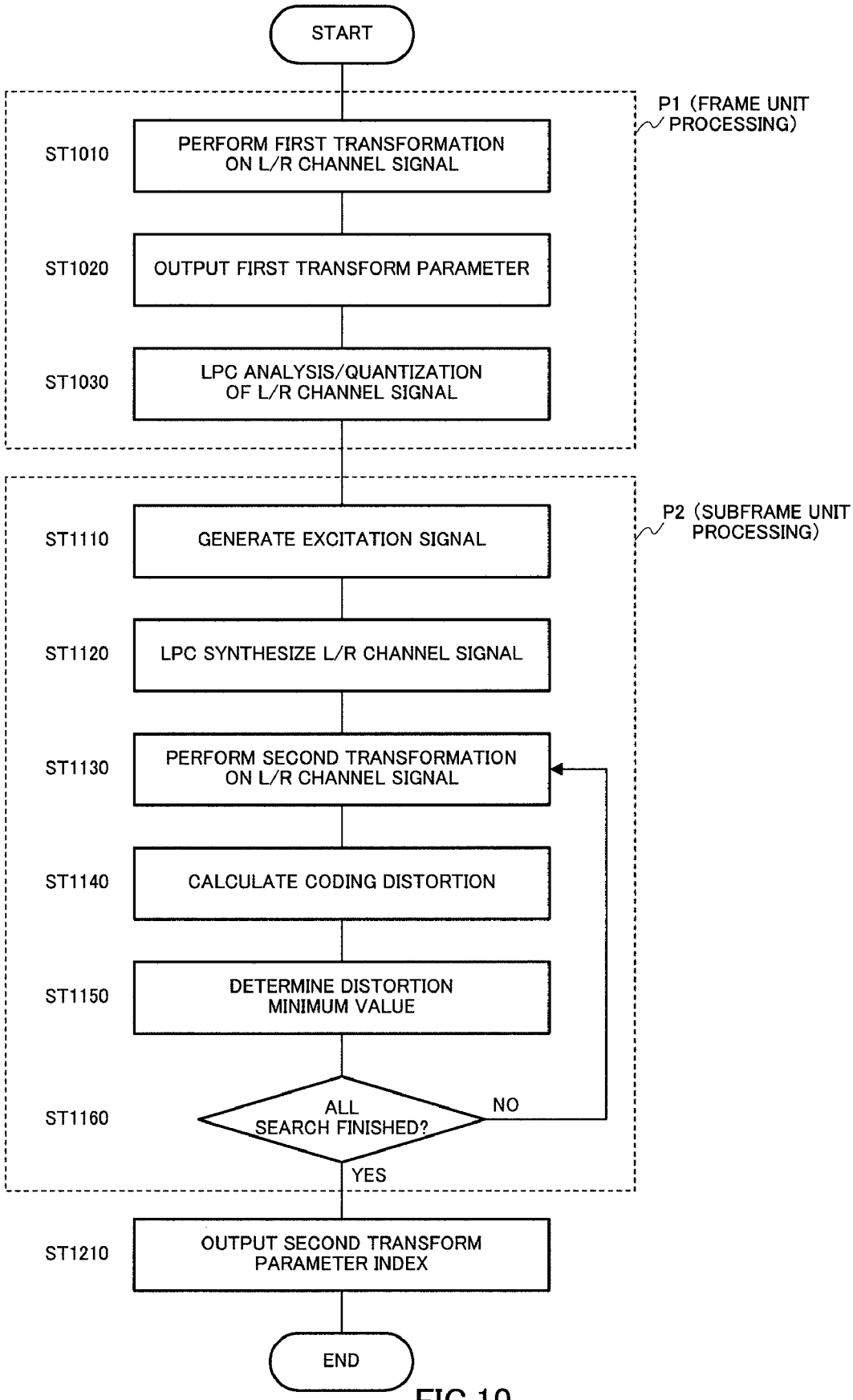
FIG. 10 is a flowchart summarizing steps of encoding processing at a second layer for an L channel and an R channel.

FIG. 10 is a flowchart summarizing the steps of encoding processing at a second layer for an L channel and an R channel.

Second layer encoder 150 performs first transform on the L channel signal and R channel signal to transform to signals similar to a monaural signal (ST1010), outputs a first transform coefficient (first transform parameter) (ST1020) and performs LPC analysis and quantization on the first transform signal (ST1030). ST1020 does not have to be between ST1010 and ST1030.

Further, second layer encoder 150 generates an excitation signal (ST1110) based on the excitation parameter decided at the first layer (adaptive codebook index, fixed codebook index and gain codebook index), and carries out LPC synthesis of the L channel signal and R channel signal (ST1120). Second transform is then carried out on these synthesis signals using a set of predetermined second transform coefficients (ST1130), and coding distortion is calculated from a second transform signal and a first transform signal close to a monaural signal (ST1140). Next, a minimum value of distortion is determined (ST1150), and the second transform coefficient is decided so that the coding distortion becomes a minimum. A loop (ST1130 to ST1150) deciding the second transform coefficient is a closed loop, a search is carried out for all indexes, and the loop ends when all searches end (ST1160). The obtained second transform coefficient index (second transform parameter index) is then outputted (ST1210).

In the above-described processing steps, processing P1 from step ST1010 to ST1030 is carried out in a frame unit, and processing P2 from ST1110 to ST1160 is carried out in a subframe unit obtained by further dividing the frame.

The processing for deciding this second transform coefficient may also be in a frame unit, and the second transform coefficient may also be outputted in a frame unit.

Next, the scalable decoding apparatus according to this embodiment corresponding to the above-described scalable encoding apparatus will be described.

Figure 14:
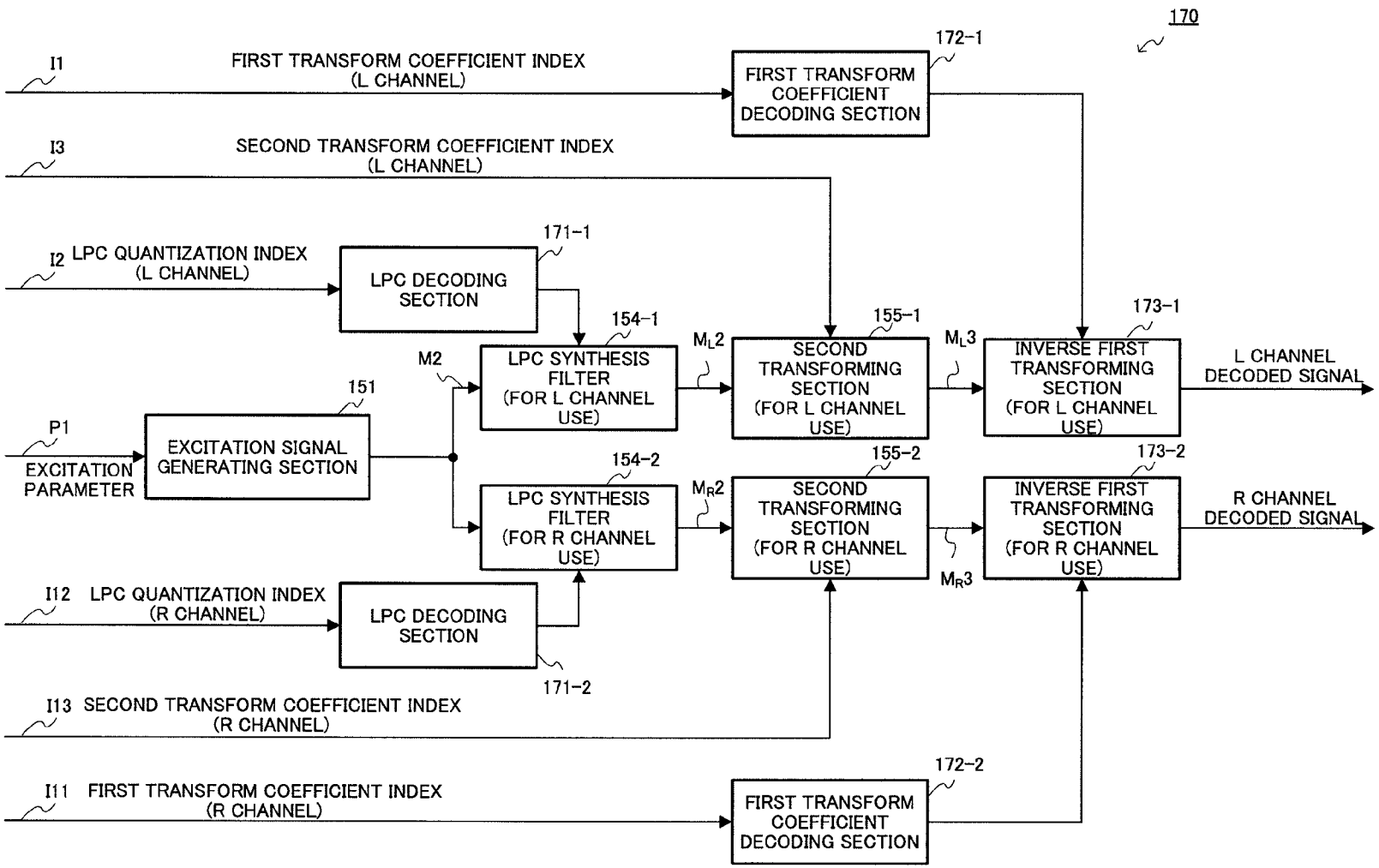
FIG. 14 is a block diagram showing the main internal configuration of a second layer decoder according to Embodiment 1.

FIG. 14 is a block diagram showing the main internal configuration of second layer decoder 170 which is particularly characteristic in the scalable decoding apparatus according to this embodiment. This second layer decoder 170 is configured to correspond to second layer encoder 150 (refer to FIG. 4) within the scalable encoding apparatus according to this embodiment. Components that are the same as those in second layer encoder 150 will be assigned the same reference numerals, and description of the duplicate operations will be omitted.

As with second layer encoder 150, second layer decoder 170 is broadly divided into an L channel processing system and an R channel processing system, and the two systems have the same configuration. Branch number 1 is assigned to reference numerals for the L channel processing system, branch number 2 is assigned for the R channel processing system, and only the L channel processing system will be described, and description of the R channel processing system will be omitted. The configuration of excitation signal generating section 151 is common to the L channel and the R channel.

The L channel processing system of second layer decoder 170 has excitation signal generating section 151, LPC synthesis filter 154-1, second transforming section 155-1, LPC decoding section 171-1, first transform coefficient decoding section 172-1 and inverse first transforming section 173-1. Excitation parameter P1, first transform coefficient index I1, LPC quantizing index I2, and second transform coefficient index I3 generated by the scalable encoding apparatus according to this embodiment are inputted to this L channel processing system.

Excitation signal generating section 151 then generates excitation signal M2 common to the L channel and R channel using inputted excitation parameter P1 and outputs this to LPC synthesis filter 154-1.

LPC decoding section 171-1 decodes quantized LPC parameters using the inputted LPC quantization index I2 and outputs this to LPC synthesis filter 154-1.

LPC synthesis filter 154-1 takes the decoded quantized LPC parameter as a filter coefficient, and takes excitation vector M2 as an excitation, and generates synthesis signal $M_L$2 of the L channel using an LPC synthesis filter. This synthesis signal $M_L$2 is outputted to second transforming section 155-1.

Second transforming section 155-1 generates second transform signal $M_L$3 by performing second transform on synthesis signal $M_L$2 using inputted second transform coefficient index I3 and outputs second transform signal $M_L$3 to inverse first transforming section 173-1. The second transform is the same processing as the second transform at second layer encoder 150.

First transforming coefficient decoding section 172-1 decodes the first transform coefficient using inputted first transform coefficient index I1 and outputs this to inverse first transforming section 173-1.

Inverse first transforming section 173-1 performs inverse first transform which is inverse transform of the first transform (at second layer encoder 150) on second transform signal $M_L$3 using the inverse of the decoded first transform coefficient and generates an L channel decoded signal.

In this way, the L channel processing system of second layer decoder 170 is capable of decoding the L channel signal. Similarly, it is also possible to decode the R channel signal using the R channel processing system of second layer decoder 170. The monaural signal can also be decoded by a monaural signal decoding section (not shown) having a configuration corresponding to monaural signal encoding section 102 (refer to FIG. 3) within the scalable encoding apparatus according to this embodiment.

As described above, according to this embodiment, the excitation is shared by each layer. Namely, encoding of each layer is carried out using the excitation common to each layer. Therefore, it is not necessary to provide a set of adaptive codebooks, fixed codebooks and gain codebooks for each layer. As a result, it is possible to implement encoding at a low bit rate, and it is possible to reduce a circuit scale. Further, at the second layer, the first transform is carried out so that each channel signal of the stereo signal becomes a signal close to the monaural signal of the waveform, and the second transform is carried out on the obtained first transform signal so that coding distortion for each channel signal becomes a minimum. In this way, it is possible to improve the speech quality. Namely, it is possible to prevent deterioration of the speech quality of a decoded signal, reduce a coding rate, and reduce the circuit scale.

In this embodiment, the case has been described as an example where the amplitude ratio (energy ratio) and time delay difference between two signals are used as a wave form difference parameter, but it is also possible to use channel characteristics (phase difference, amplitude ratio) and the like of signals of each frequency band.

Further, differential quantization, predictive quantization and the like may also be carried out on the LPC parameters for L channel signal and R channel signal where the waveform difference parameter is operated, using the quantized LPC parameter quantized with respect to the monaural signal upon quantization at the LPC quantizing section. The L channel signal and the R channel signal where the waveform difference parameter is operated are transformed to a signal close to the monaural signal. The LPC parameters of these signals therefore have high correlation with the LPC parameter of the monaural signal, so that it is possible to carry out efficient quantization at a lower bit rate.

Further, in this embodiment, the case has been described as an example where CELP coding is used as a coding scheme, but it is not necessary to perform coding using a speech model as in CELP coding, and it is not necessary to use a coding method utilizing the excitation registered in advance in a codebook.

Moreover, in this embodiment, the case has been described as an example where excitation parameters generated at monaural encoding section 102 of the first layer are inputted to second layer encoder 150, but it is also possible to input the excitation signal finally generated within monaural signal encoding section 102—the excitation signal as is which minimizes the error—to second layer encoder 150. In this case, the excitation signal is directly inputted to LPC synthesis filters 154-1 and 154-2 within second layer encoder 150.

Embodiment 2

The basic configuration of the scalable encoding apparatus according to Embodiment 2 of the present invention is the same as the scalable encoding apparatus shown in Embodiment 1. Therefore, the second layer encoder which has a different configuration from that described in Embodiment 1 will be described below.

Figure 11:
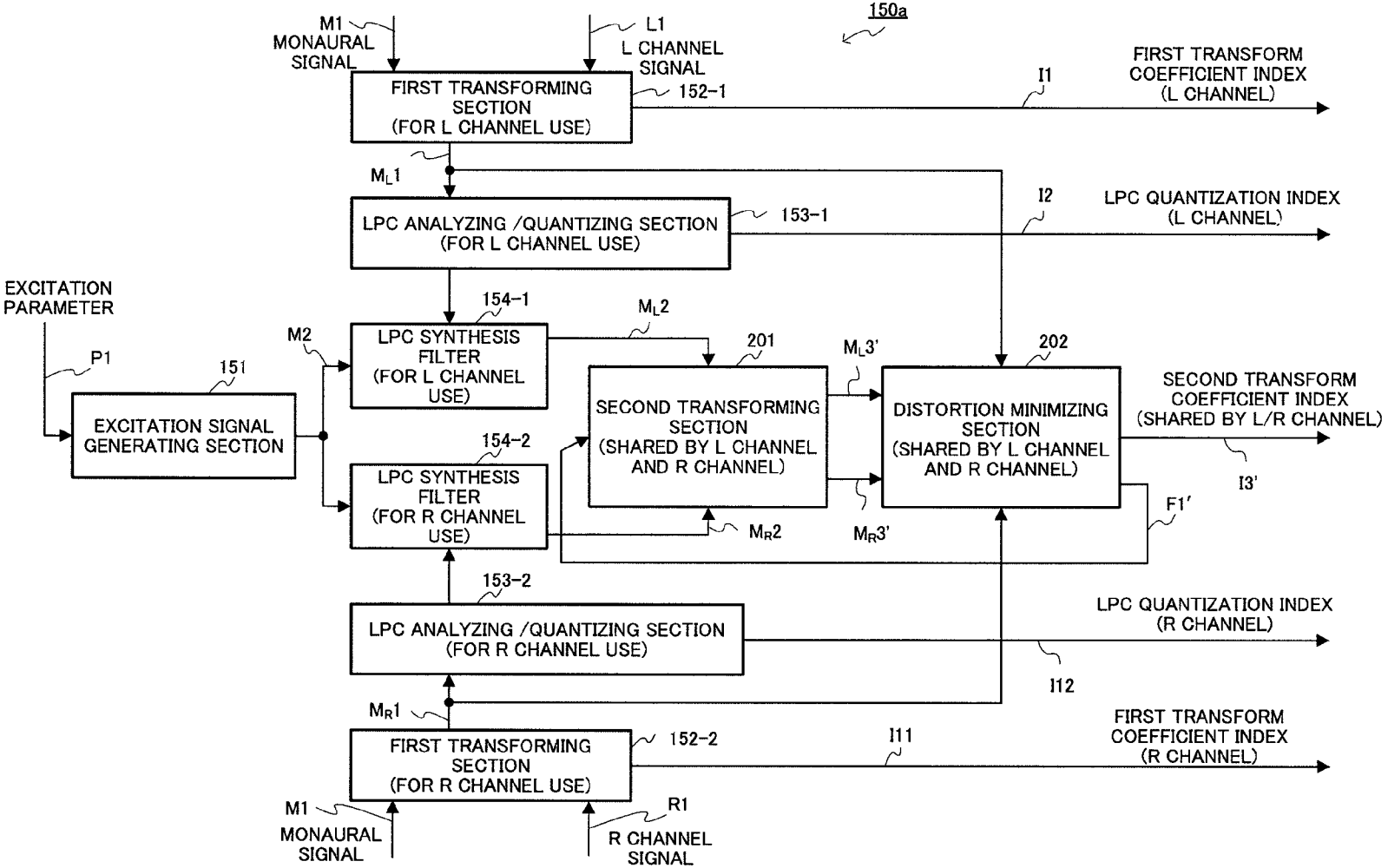
FIG. 11 is a block diagram showing the main configuration of a second layer encoder according to Embodiment 2.

FIG. 11 is a block diagram showing the main configuration of second layer encoder 150*a* according to this embodiment. Components that are the same as those in second layer encoder 150 (FIG. 4) will be assigned the same reference numerals without further explanations. The difference of configuration between Embodiment 1 and Embodiment 2 is second transforming section 201 and distortion minimizing section 202.

Figure 12:
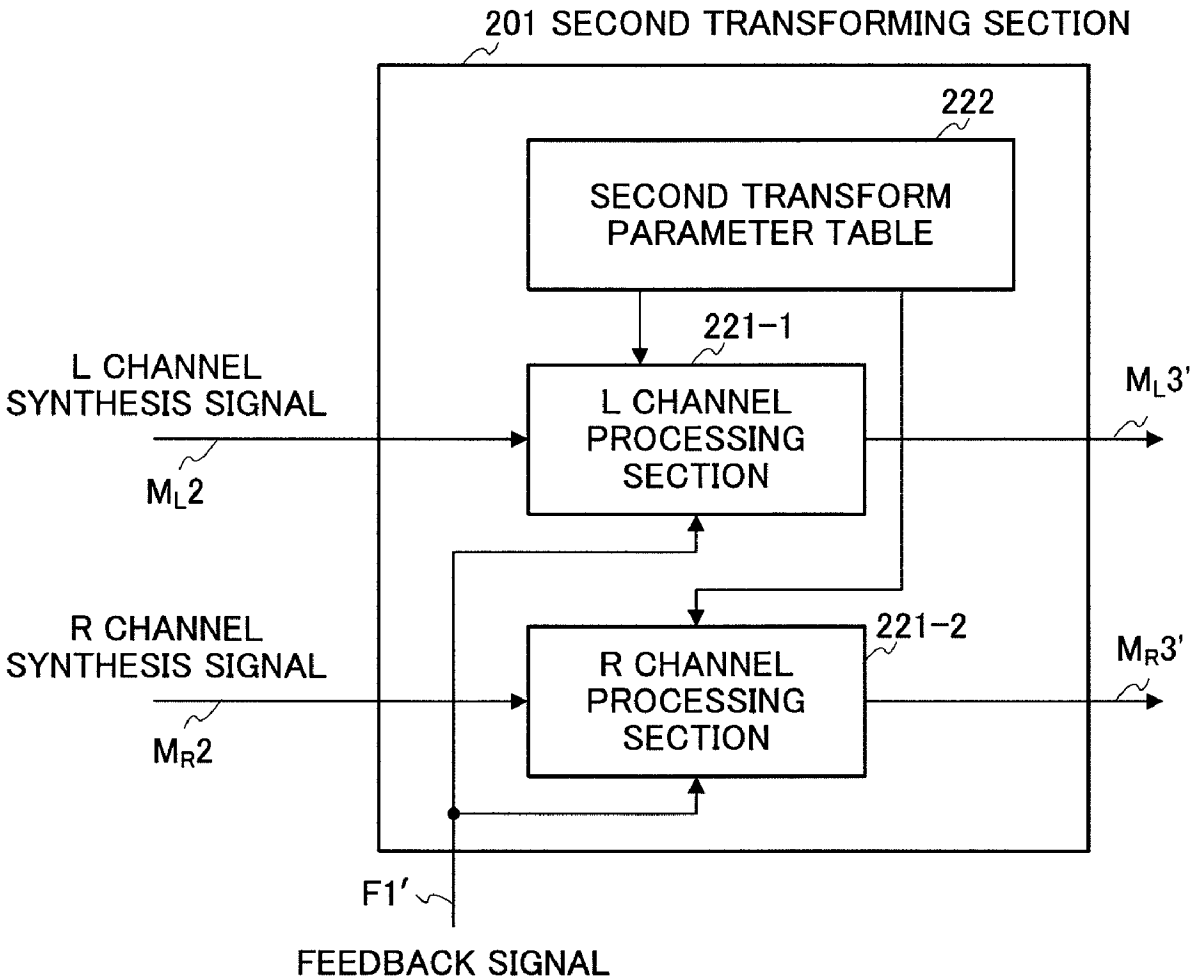
FIG. 12 is a block diagram showing the main internal configuration of a second transforming section according to Embodiment 2.

FIG. 12 is a block diagram showing the main internal configuration of second transforming section 201.

L channel processing section 221-1 within second transforming section 201 reads an appropriate second transform coefficient from second transform coefficients recorded in advance in second transform coefficient table (second transform parameter table) 222 according to feedback signal F1' from distortion minimizing section 202, performs second transform on synthesis signal $M_L$2 outputted from LPC synthesis filter 154-1 using this second transform coefficient and outputs the result (signal $M_L$3'). Similarly, R channel processing section 221-2 reads an appropriate second transform coefficient from second transform coefficients recorded in advance in second transform coefficient table 222 according to feedback signal F1' from distortion minimizing section 202, performs second transform on synthesis signal $M_R$2 outputted from LPC synthesis filter 154-2 using the second transform coefficient, and outputs the result (signal $M_R$3'). As a result of this processing, synthesis signals $M_L$2 and $M_R$2 become signals $M_L$3' and $M_R$3' similar to first transform signals $M_L$1 and $M_R$1 outputted from first transforming sections 152-1 and 152-2. Here, second transform coefficient table 222 is shared by the L channel and R channel.

The second transform is carried out according to the following equation 11 and equation 12.

[11]

$$SP_{Lch,j}(n) = \sum_{k=-KB}^{KF} \alpha_{Lch,j}(k) \cdot S_{Lch}(n-k) \quad \text{(Equation 11)}$$

(where, $n = 0, \ldots, SFL-1$)

[12]

$$SP_{Rch,j}(n) = \sum_{k=-KB}^{KF} \alpha_{Rch,j}(k) \cdot S_{Rch}(n-k) \quad \text{(Equation 12)}$$

(where, $n = 0, \ldots, SFL-1$)

Here, $S_{Lch}(n-k)$ is the L channel synthesis signal outputted from LPC synthesis filter 154-1, $S_{Rch}(n-k)$ is the R channel synthesis signal outputted from LPC synthesis filter 154-2, $SP_{Lch,j}(n)$ is the L channel signal subjected to second transform, and $SP_{Rch,j}(n)$ is the R channel signal subjected to second transform. Further, $\alpha_{Lch,j}(k)$ is a jth second transform coefficient for the L channel, $\alpha_{Rch,j}(k)$ is a jth second transform coefficient for the R channel, and $N_{cb}$ (where j=0 to $N_{cb-1}$) pairs of L channel and R channel coefficient streams are prepared in advance as a codebook. Further, SFL is a subframe length. Equations 11 and 12 are calculated for each of the pairs.

Figure 13:
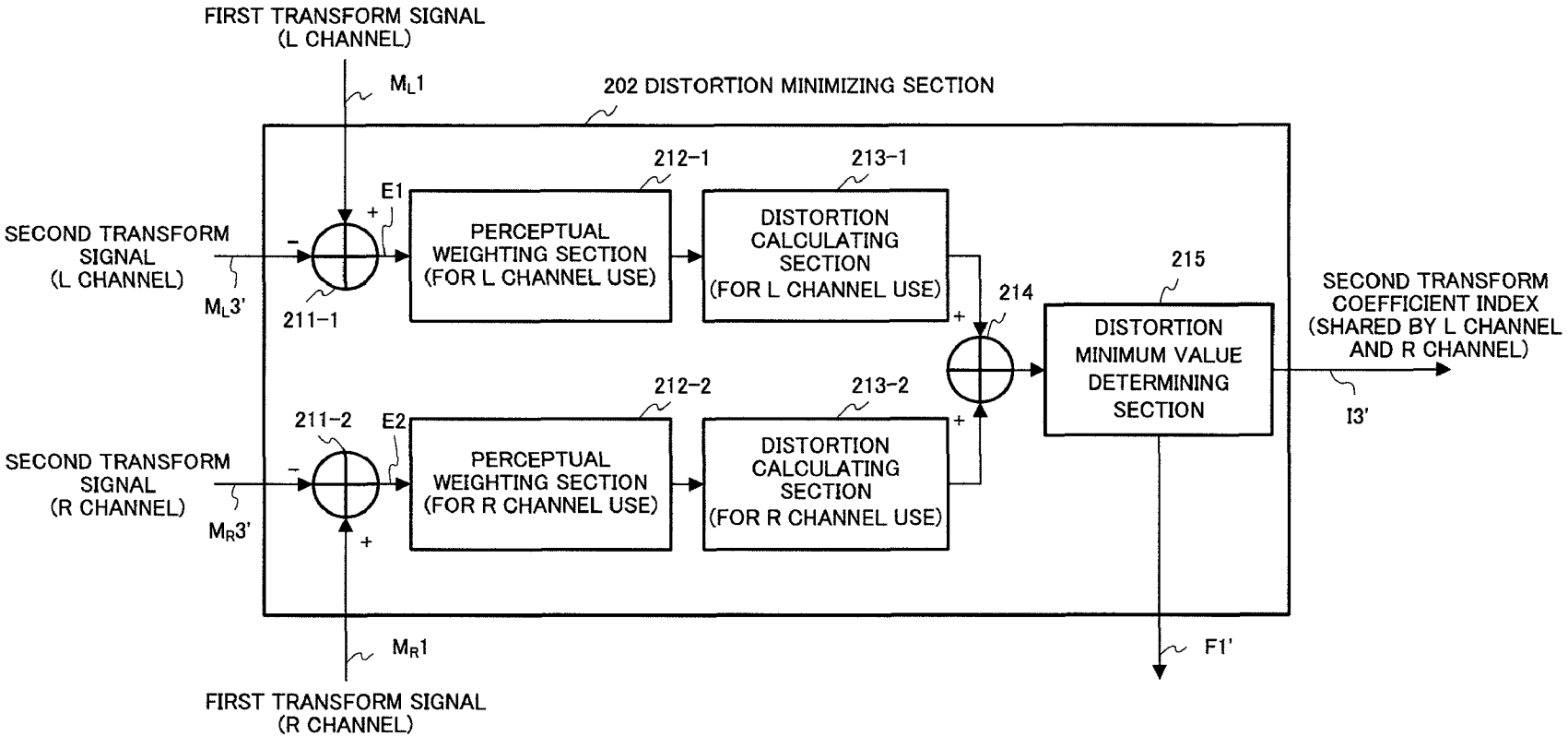
FIG. 13 is a block diagram showing the main internal configuration of a distortion minimizing section according to Embodiment 2.

Next, distortion minimizing section 202 will be described. FIG. 13 is a block diagram showing the main internal configuration of distortion minimizing section 202.

Distortion minimizing section 202 obtains an index for second transform coefficient table 222 so that the sum of the coding distortion for the second transform signals of the L channel and R channel becomes a minimum. Specifically, adder 211-1 calculates error signal E1 by subtracting second transform signal $M_L$3' from first transform signal $M_L$1 and outputs this error signal E1 to perceptual weighting section 212-1. Perceptual weighting section 212-1 then assigns perceptual weights to error signal E1 outputted from adder 211-1 using the perceptual weighting filter and outputs the result to distortion calculating section 213-1. Distortion calculating section 213-1 calculates coding distortion of error signal E1 to which perceptual weights are assigned and outputs the result to adder 214. The operation of adder 211-2, perceptual weighting section 212-2 and distortion calculating section 213-2 is the same as described above, and E2 is an error signal obtained by subtracting $M_R$3' from $M_R$1.

Adder 214 adds coding distortion outputted from distortion calculating sections 213-1 and 213-2, and outputs this sum. Distortion minimum value determining section 215 obtains an index for second transform coefficient table 222 so that the sum of coding distortion outputted from distortion calculating sections 213-1 and 213-2 becomes a minimum. The series of processing for obtaining this coding distortion configure a closed loop (feedback loop). Distortion minimum value determination section 215 therefore indicates the index of second transform coefficient table 222 to second transforming section 201 using feedback signal F1' and makes various changes to the second transform coefficients within one subframe. Index I3' indicating a set of second transform coefficients that minimizes the finally obtained coding distortion is then outputted. As described above, this index is shared by the L channel signal and the R channel signal.

Processing at distortion minimizing section 202 will be described below using mathematical expressions.

Distortion minimizing section 202 calculates difference signal $DF_{Lch,\ j}(n)$ for signal $S'_{Lch}(n)$ which is the first transform signal $M_L$1 and $SP_{Lch,\ j}(n)$ (where n=0 to SFL−1) according to the following equation 13.

[13]

$$DF_{Lch,j}(n)=S'_{Lch}(n)-SP_{Lch,j}(n) \quad \text{(Equation 13)}$$

(where, n=0, . . . , SFL−1)

Distortion minimizing section 202 calculates difference signal $DF_{Rch,\ j}(n)$ for signal $S'_{Rch}(n)$ which is the first transform signal $M_R$1 and $SP_{Rch,\ j}(n)$ (where n=0 to SFR−1) according to the following equation 14.

[14]

$$DF_{Rch,j}(n)=S'_{Rch}(n)-SP_{Rch,j}(n) \quad \text{(Equation 14)}$$

(where, n=0, . . . , SFL−1)

Coding distortion after assigning perceptual weights to difference signals $DF_{Lch,\ j}(n)$, and $DF_{Rch,\ j}(n)$ is taken as coding distortion of the scalable encoding apparatus according to this embodiment. This calculation is carried out on all sets taking pairs of second transform coefficients $\{\alpha_{Lch,\ j}(k)\}$ and $\{\alpha_{Rch,\ j}(k)\}$, and the second transform coefficients are decided so that the sum of the coding distortion for the L channel signal and R channel signal becomes a minimum.

Exactly the same set of values may be used for the set of values for $\alpha_{Lch}(k)$ and the set of values for $\alpha_{Rch}(k)$. In this case, it is possible to make the transform coefficient table size for second transform half.

According to this embodiment, second transform coefficients for the channels used in second transform of the channels are set in advance as sets of the two channels and are indicated using one index. Namely, when second transform is carried out on an LPC synthesis signal of each channel in the second layer encoding, sets of second transform coefficients of two channels are prepared in advance, a closed loop search is carried out at the same time for both channels, and second transform coefficients are decided so that coding distortion becomes a minimum. This decision is made utilizing strong correlation between the L channel signal and the R channel signal transformed to signals close to monaural signals. As a result, it is possible to reduce the coding rate.

Embodiments of the present invention have been described.

The scalable encoding apparatus and scalable encoding method according to the present invention are by no means limited to each of Embodiments described above, and various modifications thereof are possible.

The scalable encoding apparatus of the present invention can be provided to a communication terminal apparatus and base station apparatus of a mobile communication system so as to make it possible to provide a communication terminal apparatus and base station apparatus having the same operation effects as described above. Further, the scalable encoding apparatus and scalable encoding method of the present invention can be utilized in wired communication systems.

Here, the case has been described as an example where the present invention is configured with hardware, but the present invention can be implemented with soft ware. For example, it is possible to implement the same functions as the scalable encoding apparatus of the present invention by describing algorithms for processing of the scalable encoding method according to the present invention using programming language, and storing this program in a memory for implementation by an information processing section.

Further, the adaptive codebook may also be referred to as an adaptive excitation codebook, and the fixed codebook may also be referred to as a fixed excitation codebook.

Each function block employed in the description of each of the aforementioned embodiments may typically be implemented as an LSI constituted by an integrated circuit. These functions may each be individually incorporated on a single chip or may also be incorporated on a single chip collectively or in their entirety.

Further, "LSI" is adopted here but this may also be referred to as "IC", "system LSI", "super LSI", or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application in biotechnology is also possible.

The present application is based on Japanese Patent Application No. 2005-025123, filed on Feb. 1, 2005, the entire content of which is expressly incorporated by reference herein.

INDUSTRIAL APPLICABILITY

The scalable encoding apparatus and scalable encoding method according to the present invention may be applied to a communication terminal apparatus, a base station apparatus and the like of a mobile communication system.

The invention claimed is:

1. A scalable encoding apparatus, comprising:

a monaural signal generator that generates a monaural signal using a plurality of channel signals constituting a stereo signal, the plurality of channel signals including a first channel signal and a second channel signal;

a first encoder that encodes the monaural signal and generates an excitation parameter;

a monaural similar signal generator that generates a first monaural similar signal using only the first channel signal and the monaural signal;

a synthesizer that generates a synthesis signal using the excitation parameter and the first monaural similar signal; and a second encoder that generates a distortion minimizing parameter using the synthesis signal and the first monaural similar signal.

2. The scalable encoding apparatus according to claim 1, wherein the monaural signal generator takes an average of the plurality of channel signals as the monaural signal.

3. The scalable encoding apparatus according to claim 1, wherein the first encoder performs CELP encoding on the monaural signal and generates the excitation parameter.

4. The scalable encoding apparatus according to claim 1, wherein the monaural similar signal generator obtains information relating to differences in the waveforms between the first channel signal and the monaural signal.

5. The scalable encoding apparatus according to claim 4, wherein information relating to the difference in waveforms is information relating to both or one of energy and delay time.

6. The scalable encoding apparatus according to claim 4, wherein the monaural similar signal generating section makes an error in the waveforms between the first channel signal and the monaural signal smaller using the information relating to the difference in the waveforms.

7. The scalable encoding apparatus according to claim 1, wherein the synthesizer calculates a filter coefficient using the first monaural similar signal, generates an excitation using the excitation parameter, and generates a synthesis signal by carrying out LPC synthesis using the filter coefficient and the excitation.

8. The scalable encoding apparatus according to claim 1, wherein the synthesizer generates synthesis signals corresponding to the channel signals using the excitation parameter in common for the plurality of channel signals.

9. The scalable encoding apparatus according to claim 1, wherein the second encoder generates a second monaural similar signal using the synthesis signal, and generates the distortion minimizing parameter that minimizes a difference between the first monaural similar signal and the second monaural similar signal.

10. The scalable encoding apparatus according to claim 1, wherein the second encoder stores candidates for the distortion minimizing parameter in advance.

11. The scalable encoding apparatus according to claim 1, wherein the second encoder stores a plurality of candidates for the distortion minimizing parameter corresponding to the plurality of channel signals in advance in sets between the plurality of channels.

12. The scalable encoding apparatus according to claim 11, wherein the second encoder obtains distortion between the synthesis signal and the monaural similar signal for each channel signal from the candidates for the distortion minimizing parameter, and obtains a set of the distortion minimizing parameters that minimize the total of the distortions.

13. A communication terminal apparatus, comprising the scalable encoding apparatus according to claim 1.

14. A base station apparatus, comprising the scalable encoding apparatus according to claim 1.

15. A scalable encoding method, comprising:

generating a monaural signal using a plurality of channel signals constituting a stereo signal, the plurality of channel signals including a first channel signal and a second channel signal;

encoding the monaural signal and generating an excitation parameter;

generating a first monaural similar signal using only the first channel signal and the monaural signal;

generating a synthesis signal using the excitation parameter and the first monaural similar signal; and generating a distortion minimizing parameter using the synthesis signal and the first monaural similar signal.

16. The scalable encoding method according to claim 15, wherein generating the monaural signal includes taking an average of the plurality of channel signals as the monaural signal.

17. The scalable encoding method according to claim 15, wherein the encoding the monaural signal includes performing CELP encoding on the monaural signal and generating the excitation parameter.

18. The scalable encoding method according to claim 15, wherein the generating a synthesis signal includes calculating a filter coefficient using the first monaural similar signal, generating an excitation using the excitation parameter, and generating the synthesis signal by carrying out LPC synthesis using the filter coefficient and the excitation.

19. The scalable encoding method according to claim 15, wherein the generating a synthesis signal includes generating synthesis signals corresponding to the plurality of channel signals using the excitation parameter in common for the plurality of channel signals.

20. The scalable encoding method according to claim 15, further comprising:

generating a second monaural similar signal using the synthesis signal, and generating the distortion minimizing parameter that minimizes a difference between the first monaural similar signal and the second monaural similar signal.

* * * * *